US006860053B2

(12) United States Patent
Christiansen

(10) Patent No.: US 6,860,053 B2
(45) Date of Patent: Mar. 1, 2005

(54) GRIP FRICTION PATTERN

(76) Inventor: Ned F. Christiansen, 55017 Flatbush Rd., Three Rivers, MI (US) 49093

( * ) Notice: Subject to any disclaimer, the term of this patent is extended or adjusted under 35 U.S.C. 154(b) by 0 days.

(21) Appl. No.: 10/453,077

(22) Filed: Jun. 2, 2003

(65) Prior Publication Data

US 2004/0049963 A1 Mar. 18, 2004

Related U.S. Application Data

(60) Provisional application No. 60/385,237, filed on Jun. 1, 2002.

(51) Int. Cl.[7] ..... F41C 23/00

(52) U.S. Cl. ..... 42/71.02; 42/7; 42/71.01; 42/72; D22/117; D22/104; D22/108

(58) Field of Search ..... 42/7, 71.01, 71.02, 42/72; 152/208, 209, 209.3; 305/173, 185; D22/117, 104, 108

(56) References Cited

U.S. PATENT DOCUMENTS 2,701,930 A * 2/1955 Dolan ..... 428/19
3,805,865 A * 4/1974 Price ..... 152/209.15
4,043,066 A * 8/1977 Pachmayr et al. ..... 42/71.02
4,171,718 A * 10/1979 Walrave et al. ..... 152/222
4,246,707 A * 1/1981 Pedersen ..... 36/100
4,346,530 A * 8/1982 Stewart et al. ..... 42/71.01
4,476,742 A * 10/1984 Midgley ..... 74/551.9
4,586,282 A * 5/1986 Sniezak ..... 42/71.02
4,722,378 A * 2/1988 Carolla et al. ..... 152/209.15
5,203,933 A * 4/1993 Nagahisa ..... 152/209.15
5,369,828 A * 12/1994 Graebe ..... 5/654
5,406,731 A * 4/1995 Stevens ..... 42/71.02
5,461,741 A * 10/1995 Graebe ..... 5/654
5,632,537 A * 5/1997 Yoshimura et al. ..... 305/173
5,839,977 A * 11/1998 Maurer et al. ..... 473/446
5,857,279 A * 1/1999 de Oliveira Masina .... 42/71.01
5,983,506 A * 11/1999 Glesser ..... 30/340
6,177,171 B1 * 1/2001 Constantinides ..... 428/101
6,199,447 B1 * 3/2001 Lump et al. ..... 74/551.9
6,371,179 B1 * 4/2002 Tsuda ..... 152/209.16
6,485,378 B1 * 11/2002 Boehm ..... 473/374
6,605,243 B1 * 8/2003 Masutani ..... 264/278

* cited by examiner

*Primary Examiner*—Michael J. Carone
*Assistant Examiner*—John Richardson
(74) *Attorney, Agent, or Firm*—Geoffrey E. Dobbin

(57) ABSTRACT

The present invention discloses a grip fractioning pattern for any object, but specifically designed for handgun and rifle grips. The pattern consists of a series of spaces frusto-conical projections regularly spaced about the surface of the weapon's grip. Alternatively, the series may be interrupted by an interspaced series of pyramids, with their points not extending above the height of the frusto-conical projections. The grip pattern may be utilized in any circumstance where a user desires greater and more comfortable friction when gripping an object.

4 Claims, 2 Drawing Sheets

GRIP FRICTION PATTERN

CROSS-REFERENCE TO RELATED APPLICATIONS

This Application claims priority based on earlier filed Provisional Application 60/385,237, filed Jun. 1, 2002.

FIELD OF INVENTION

The present invention relates to friction patterns for firearm and other grips and more specifically relates to the use of spaced apart projections of a combination of shapes to provide friction for gripping a firearm grip. The pattern may be used in any circumstance where increased friction would be desired to achieve a comfortable hold on an object with a hand.

BACKGROUND OF THE INVENTION

The addition of friction, or fractioning, patterns to a grip surface is known in the prior art. Their basic function is to disrupt any uniformity in the grip surface to increase friction and provide a better interface between a hand (or other holding apparatus) and the grip surface. Often times, as in the case of robotics, a grasping apparatus is employed and that grasping apparatus has a friction pattern. One common field in which friction patterns are employed is weapon grips. For example, U.S. Pat No. 5,615,505 to Vaid (1997); U.S. Pat. No. 5,557,872 to Langner (1996); U.S. Pat. No. 5,437,118 to Sniezak, et al. (1995); U.S. Pat. No. 5,341,586 to Aluotto, et al. (1994); U.S. Pat No. 4,742,634 to Swenson (1988); U.S. Pat. No. D430,916 to Bubits (2000); U.S. Pat. No. D 377,513 to Lenarski, et al. (1997); U.S. Pat. No. D345,002 to Strayer, et al. (1994); U.S. Pat. No. D 273,316 to Lambert (1984); U.S. Pat. No. D272,938 to Mueschke (1984).

Increased friction is usually achieved in one of two ways. First, a pattern may be etched into the grip surface. The other method is to raise various parts of the grip surface. Sometimes both methods may be used to achieve the desired effect. Usually, etching leaves a tight, regular pattern (usually squares or diamonds). Raising is usually done by fashioning a bar pattern in the mold for the object to be gripped. Sometimes, the raised pattern may also be a jagged pattern.

While the aforementioned inventions accomplish their individual objectives, they do not describe a pattern that utilizes two distinct shapes in a fractioning pattern. They also do not describe a pattern utilizing a combination of flat and pointed shapes. In this respect, the friction pattern according to the present invention departs substantially from the usual designs in the prior art. In doing so, this invention provides an improved friction pattern, one that is both effective and comfortable, utilizing two distinct three-dimensional shapes to attain the desired result.

SUMMARY OF THE INVENTION

In view of the foregoing disadvantages inherent in the known types of friction patterns, this invention provides an improved friction pattern that is both effective and comfortable. As such, the present invention's general purpose is to provide a new and improved friction pattern that will provide a positive gripping surface while simultaneously diminishing the discomfort associated with pointed friction patterns To attain this goal, the preferred embodiment of the friction pattern utilizes a plurality of projections, each shaped according to one of two classes of shapes. The first class of shape is frusto-conical. A uniform pattern of frusto-conical projections provides a flat surface in which to grab. A second class of shapes is pyramidical, providing the user a positive grip. The frusto-conical projections then serve to prevent the user from applying too much pressure and injuring a hand on the pyramidical projections. Ideally, the patterns should be regular and interspaced with each other. However, other variations would also come within the purview of this application.

The pattern works by providing space between the frusto-conical projections, allowing for a user's hand to "fill-in" the gaps, and a pint with each pyramid, providing a higher coefficient of friction. Together, the pattern provides a better grip, without catching the user's hand, a problem associated with a pointed surface.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
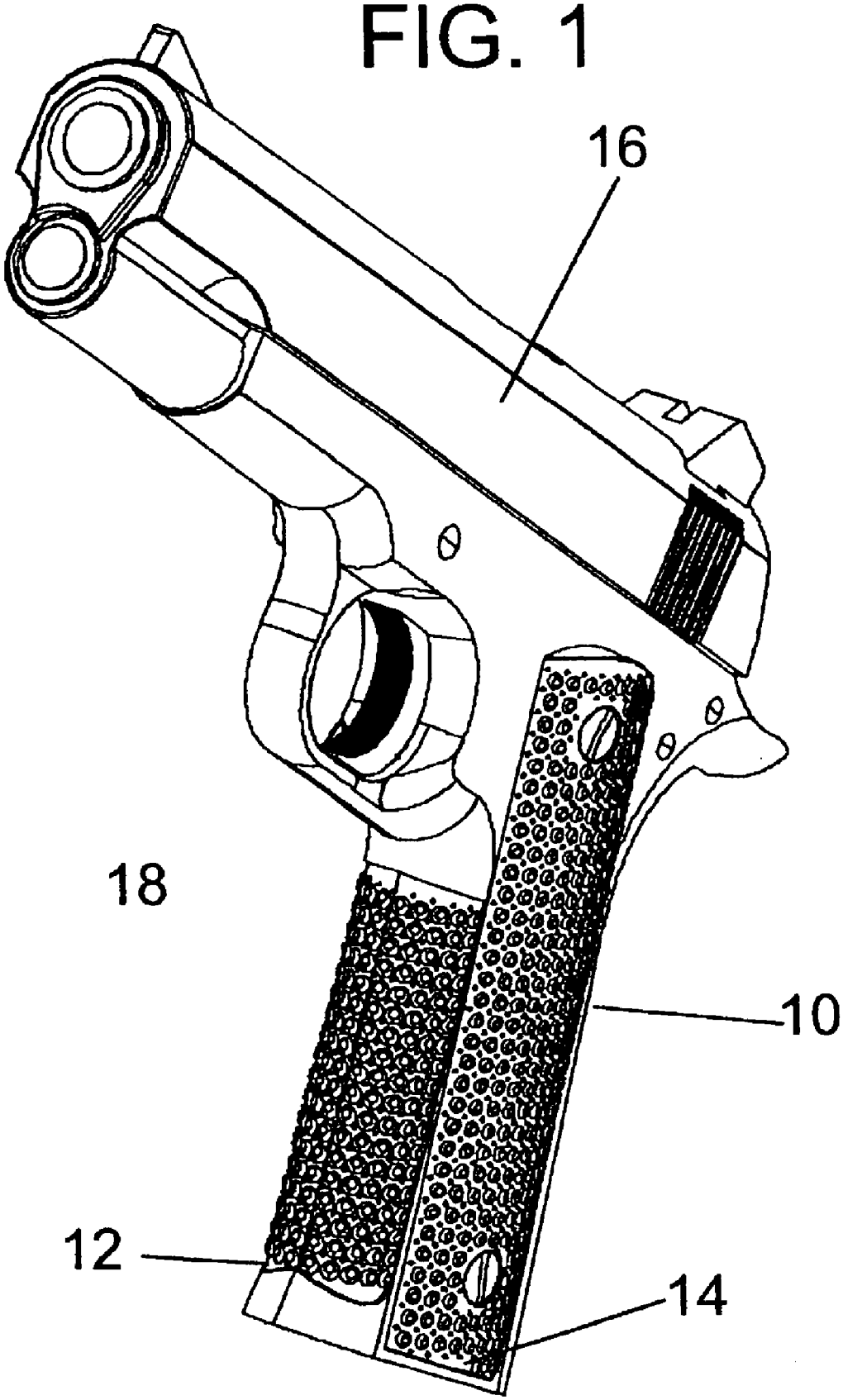
FIG. 1 is a perspective view of a handgun with the preferred embodiment of the invention applied to its grip.
Figure 2:
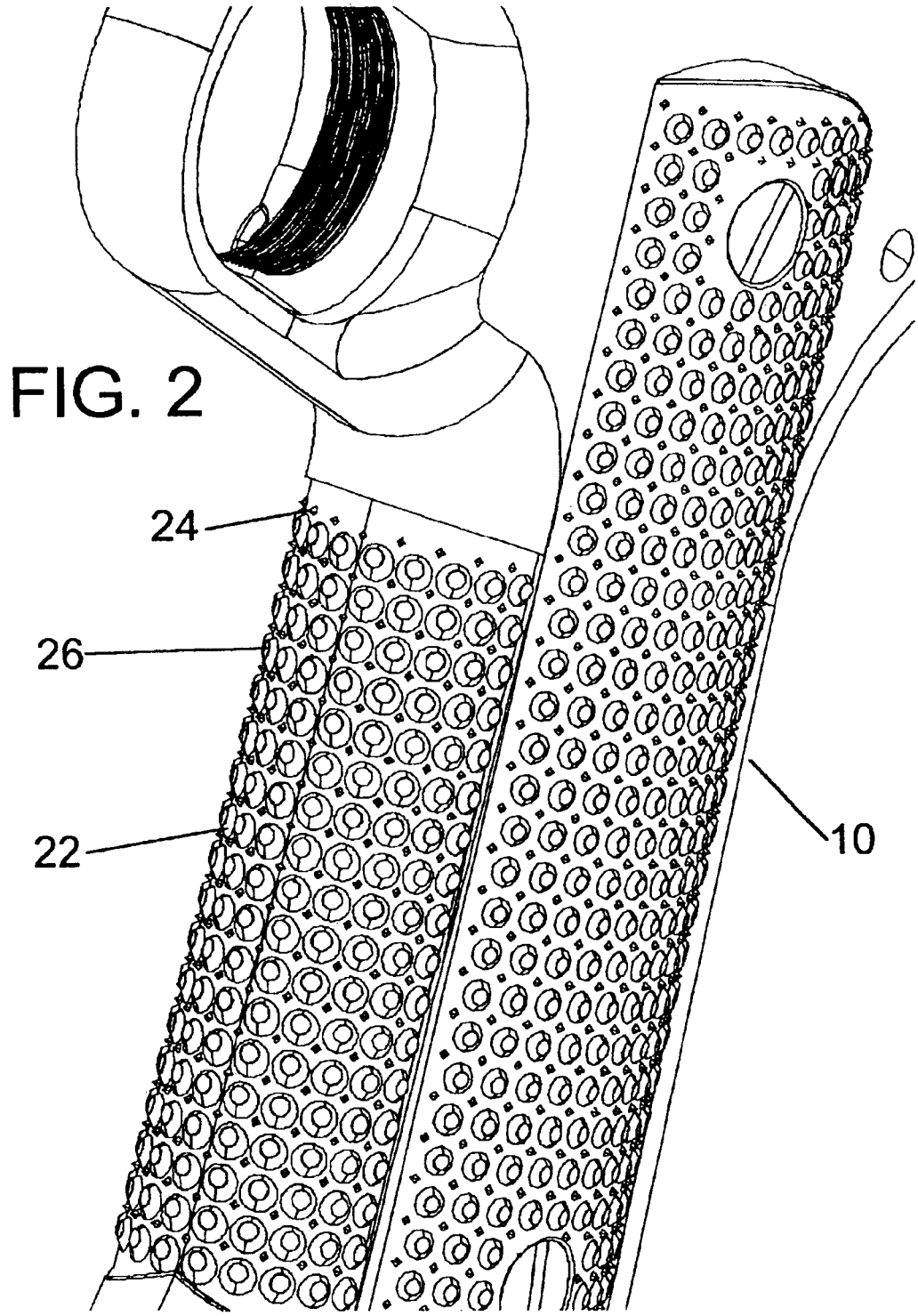
FIG. 2 is a close-up view of the invention as applied in FIG. 1.

With reference now to the drawings, the preferred embodiment of the friction pattern is herein described. Referring to FIG. 1, the pattern 10 is applied to any surface that is to be grasped. In this case pattern 10 is applied to the fore strap 12 and side panels 14 of a handgun's 16 grip 18, thought the pattern may be used on any surface on any object that is to be grasped. In its preferred embodiment, shown in FIG. 2 the pattern consists of a regularly repeated pattern of frusto-conical projections 22 and pyramidical projections 24. The pyramidical projections 24 may have a base of any shape, such as a circle, triangle, square, and so forth. The drawings should not be seen as limiting on this feature. Preferably, the pyramidical projections 24 will be a four-sided pyramid, with a square base. Ideally, the pattern should alternate one frusto-conical projection 22 and one pyramidical projection 24, however, random patterns would also provide an improved friction surface. Because of the space between the tops 26 of the frusto-conical projections 22, an improved surface can be provided without pyramidical projections.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A fractioning pattern for any type of gripping surface oomprising:

a. a repeated series of a plurality of uniform frusto-conical projections, each projection having a base, a height, a center defined by a conical axis and a diameter defined at the base of the projection, positioned on a gripping surface; and;

b. a plurality of pyramid projections, interspersed within the series of frusto-conical projections.

2. The fractioning pattern of claim 1, each pyramid projection having a height no higher than the height of a frusto-conical projection.

3. The fractioning pattern of claim 2, wherein the shape of the pyramid projections is chosen from the group of shapes consisting of: a cone, a three-sided pyramid, a four-sided pyramid, a five-sided pyramid and a six-sided pyramid.

4. The fractioning pattern of claim 1, each pyramid projection having a height no greater than the height of a frusto-conical projection.

* * * * *